US011234566B2

(12) United States Patent
Hwang et al.

(10) Patent No.: US 11,234,566 B2
(45) Date of Patent: Feb. 1, 2022

(54) CLEANER

(71) Applicant: LG Electronics Inc., Seoul (KR)

(72) Inventors: Jungbae Hwang, Seoul (KR); Sangyoung Song, Seoul (KR); Taekgi Lee, Seoul (KR); Jinrae Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 16/261,100

(22) Filed: Jan. 29, 2019

(65) Prior Publication Data

US 2019/0231154 A1 Aug. 1, 2019

(30) Foreign Application Priority Data

Jan. 29, 2018 (KR) ..... 10-2018-0010952

(51) Int. Cl.
*A47L 5/24* (2006.01)
*A47L 9/16* (2006.01)
(Continued)

(52) U.S. Cl.
CPC ..... *A47L 5/24* (2013.01); *A47L 9/02* (2013.01); *A47L 9/12* (2013.01); *A47L 9/127* (2013.01);
(Continued)

(58) Field of Classification Search
CPC ..... A47L 5/24; A47L 9/02; A47L 9/10; A47L 9/12; A47L 9/125; A47L 9/127;
(Continued)

(56) References Cited

U.S. PATENT DOCUMENTS 3,832,833 A * 9/1974 Cox ..... B01D 46/0004 55/378
4,488,883 A * 12/1984 Philp ..... A47L 9/127 55/311
(Continued)

FOREIGN PATENT DOCUMENTS

CN 202235167 U * 5/2012
CN 203539240 4/2014
(Continued)

OTHER PUBLICATIONS

CN Office Action in Chinese Appln. No. 201880087941, dated Mar. 25, 2021, 16 pages (with English translation).

*Primary Examiner* — Joseph J Hail
*Assistant Examiner* — Jonathan R Zaworski
(74) *Attorney, Agent, or Firm* — Fish & Richardson P.C.

(57) ABSTRACT

The cleaner includes a main body having an opening, a suction motor accommodated in the main body and configured to generate suction force, an opening cover separably coupled to the main body and configured to cover the opening, and a filter mechanism accommodated in the main body through the opening and configured to filter foreign substances of air discharged by the suction motor. When the opening cover is separated from the main body, at least a portion of the filter mechanism protrudes to the outside of the main body through the opening. While the opening cover is coupled to the main body, at least a portion of the filter mechanism protruding to the outside of the main body is pressed by the opening cover so as to be accommodated in the main body.

20 Claims, 8 Drawing Sheets

(51) Int. Cl.
*A47L 9/12* (2006.01)
*A47L 9/28* (2006.01)
*A47L 9/02* (2006.01)
*A47L 9/32* (2006.01)

(52) U.S. Cl.
CPC ..... *A47L 9/1608* (2013.01); *A47L 9/1633* (2013.01); *A47L 9/1641* (2013.01); *A47L 9/1683* (2013.01); *A47L 9/2884* (2013.01); *A47L 9/322* (2013.01)

(58) Field of Classification Search
CPC .... A47L 9/1427; A47L 9/1608; A47L 9/1633; A47L 9/1641; A47L 9/1666; A47L 9/1683; A47L 9/2884; A47L 9/322; A47L 11/4027; B04C 2009/004; B01D 46/0002; B01D 46/0004; B01D 46/0005
USPC ..... 15/347
See application file for complete search history.

(56) References Cited

U.S. PATENT DOCUMENTS 4,964,898 A * 10/1990 Toda ..... B01D 45/02 55/323
5,855,634 A * 1/1999 Berfield ..... B01D 46/2414 55/472
7,721,385 B2 * 5/2010 Genn ..... A47L 9/122 15/347
8,424,154 B2 * 4/2013 Beskow ..... A47L 9/20 15/352
2006/0156508 A1 * 7/2006 Khalil ..... A47L 9/1666 15/353
2007/0113529 A1 * 5/2007 Gierer ..... B01D 46/0005 55/498
2007/0163075 A1 * 7/2007 Butler ..... A47L 9/04 15/410
2011/0314631 A1 * 12/2011 Conrad ..... A47L 5/225 15/347
2014/0298612 A1 * 10/2014 Williams ..... A47L 7/0004 15/347
2017/0280950 A1 10/2017 Nam et al.
2017/0280951 A1 * 10/2017 Nam ..... A47L 5/28
2017/0280952 A1 10/2017 Nam et al.
2017/0280959 A1 * 10/2017 Nam ..... A47L 9/1641
2017/0296958 A1 10/2017 Nam et al.
2017/0332860 A1 11/2017 Nam et al.
2018/0333022 A1 11/2018 Nam et al.
2018/0333023 A1 11/2018 Nam et al.
2018/0333024 A1 11/2018 Nam et al.
2018/0333025 A1 11/2018 Nam et al.
2018/0333026 A1 11/2018 Nam et al.
2018/0333029 A1 11/2018 Nam et al.
2018/0333030 A1 11/2018 Nam et al.
2018/0333031 A1 11/2018 Nam et al.
2018/0333032 A1 11/2018 Nam et al.
2018/0333033 A1 11/2018 Nam et al.

FOREIGN PATENT DOCUMENTS

CN 106510549 A * 3/2017
DE 102008062601 A1 * 6/2010 ..... A47L 9/1481
EP 0045036 1/1985
EP 2225993 A1 * 9/2010 ..... A47L 9/20
JP 2009279284 12/2009
JP 2015204925 11/2015
KR 1020170112911 10/2017
TW 201735847 10/2017
WO WO-2010102394 A1 * 9/2010 ..... A47L 9/1691
WO WO-2012073576 A1 * 6/2012 ..... A47L 9/20

* cited by examiner

CLEANER

CROSS-REFERENCE TO RELATED APPLICATIONS

The present application claims priority under 35 U.S.C. 119 and 35 U.S.C. 365 to Korean Patent Application No. 10-2018-0010952, filed on Jan. 29, 2018, which is hereby incorporated by reference in its entirety.

BACKGROUND

The present disclosure relates to a cleaner.

A cleaner is a device that performs cleaning by suctioning and wiping dust or foreign substances on a surface to be cleaned.

Cleaners may be classified into a manual cleaner that a user moves in person for cleaning and an automatic cleaner that automatically moves for cleaning.

Manual cleaners may fall into, depending on the types, a canister cleaner, an upright cleaner, a handy cleaner, and a stick cleaner.

A hand-held vacuum cleaner is disposed in Korean patent Publication No. 10-1127088 (Mar. 8, 2012) that is prior art document.

The hand-held vacuum cleaner may include a suction tube, an air flow generator, a centrifugal separation device, a power source, and a handle.

The air flow generator is disposed in a motor housing and a shape of a motor and fan assembly. A pre-motor filter may be disposed at the front of the air flow generator, and a post-motor filter may be disposed at the rear of the air flow generator.

When the motor of the hand-held vacuum cleaner is driven, an air flow may be generated along the suction tube, and air existing around a target area to be cleaned may be suctioned through a suction hole.

Foreign substance contained in the air suctioned through the suction hole may be collected into an upstream cyclone by the centrifugal separation device. Also, the air that is partially cleaned by the upstream cyclone may be introduced into a downstream cyclone. In the downstream cyclone, foreign substances having a particle size less than that of the foreign substances collected in the upstream cyclone may be separated.

The foreign substances remaining in the air passing through the downstream cyclone may be discharged from the centrifugal separation device and be filtered again while successively passing through the pre-motor filter and the post-motor filter and then discharged to the outside of the hand-held vacuum cleaner.

Here, to prevent the foreign substances, which are not separated from the upstream and downstream cyclones from being discharged to the outside, foreign substance filtering performance of the pre-motor filter and the post-motor filter is important.

Also, as a cleaning time is accumulated, the foreign substances may be accumulated on the filter. The foreign substances accumulated on the filter may act as flow resistance on a passage of the cleaner to deteriorate suction performance of the cleaner. Thus, to reduce the deterioration of the suction performance of the cleaner, it is necessary to sufficiently secure an area of the filter.

In case of the related art, to increase the area of the filter, it is necessary to increase a size of a space in which each filter is accommodated. Therefore, there is a limitation that an internal structure of the hand-held vacuum cleaner has to be changed.

SUMMARY

Embodiments provide a cleaner in which discharge of foreign substances is capable of being reduced.

Embodiments also provide a cleaner in which foreign substance filtering performance is capable of being improved without changing a structure of a cleaner body.

Embodiments also provide a cleaner in which deterioration of suction performance according to accumulation of a cleaning time is capable of being reduced.

In one embodiment, a cleaner includes: a main body having an opening; a suction motor accommodated in the main body and configured to generate suction force; an opening cover separably coupled to the main body and configured to cover the opening; and a filter mechanism accommodated in the main body through the opening and configured to filter foreign substances of air discharged by the suction motor, wherein, when the opening cover is separated from the main body, at least a portion of the filter mechanism protrudes to the outside of the main body through the opening, and while the opening cover is coupled to the main body, at least a portion of the filter mechanism protruding to the outside of the main body is pressed by the opening cover so as to be accommodated in the main body.

In another embodiment, a cleaner includes: a main body having an opening; a suction motor accommodated in the main body and configured to generate suction force; an opening cover separably coupled to the main body and configured to cover the opening; a filter member accommodated in the main body through opening and including a filter unit configured to filter air and an upper body coupled to an upper portion of the filter unit; and a filter frame configured to support the filter member and including an upper frame disposed below the upper body, wherein, when the opening cover is separated from the main body, the upper body is spaced apart from the upper frame, and while the opening cover is coupled to the main body, the upper body approaches the upper frame, and at least a portion of the filter unit is bent.

In further another embodiment, a cleaner includes: a main body having an opening; a suction motor accommodated in the main body and configured to suction force; an opening cover separably coupled to the main body and configured to cover the opening; a filter member accommodated in the main body through opening and including a filter unit configured to filter air and an upper body coupled to an upper portion of the filter unit; and a filter frame configured to support the filter member and including an upper frame disposed below the upper body, wherein, when the opening cover is separated from the main body, the filter member protrudes to the outside of the main body through the opening, and when the opening cover is coupled to the main body, the filter member protruding to the outside of the main body is compressed by the opening cover and accommodated in the main body.

The details of one or more embodiments are set forth in the accompanying drawings and the description below. Other features will be apparent from the description and drawings, and from the claims.

DETAILED DESCRIPTION OF THE EMBODIMENTS

Figure 1:
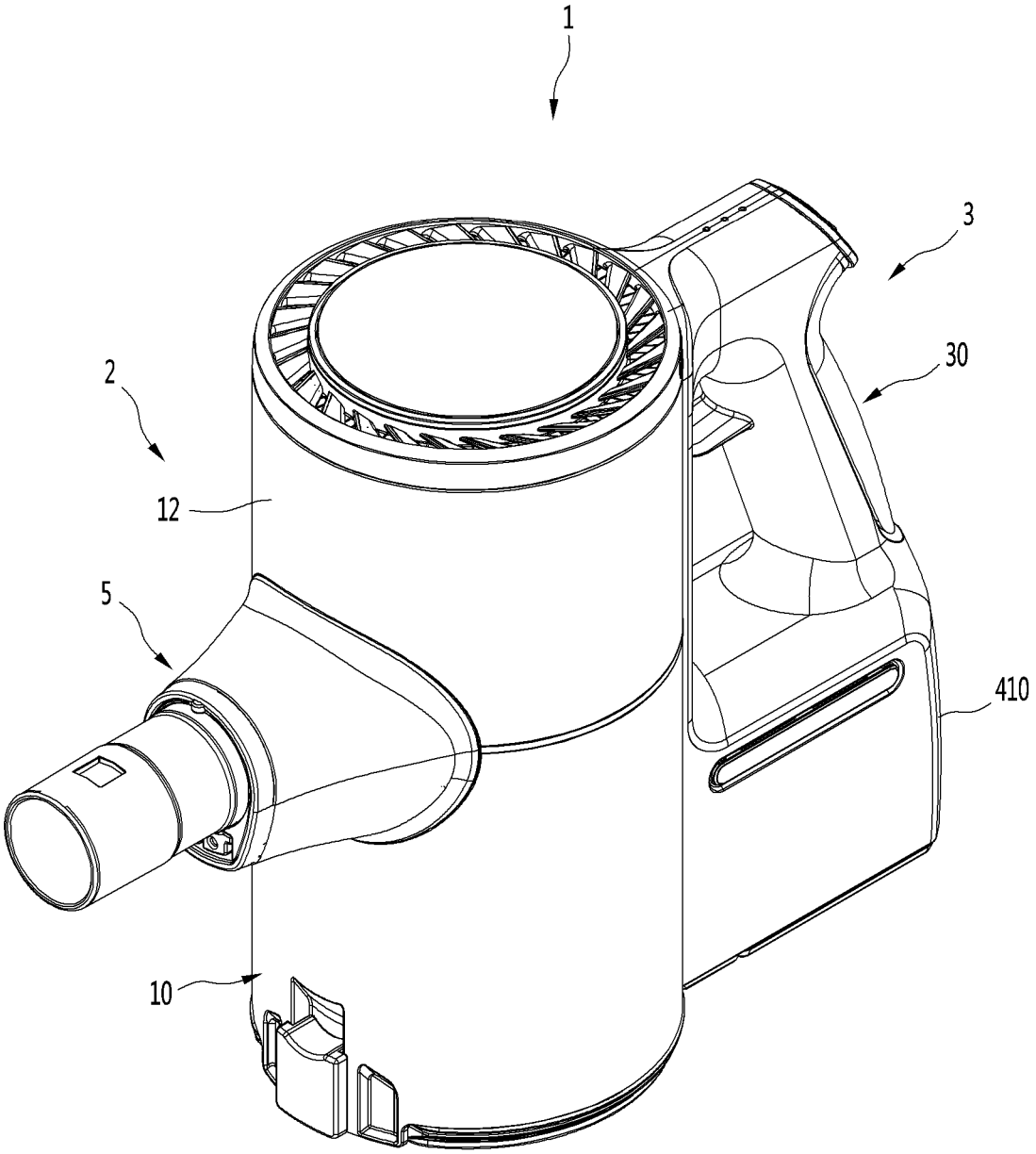
FIG. 1 is a perspective view of a cleaner according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected % coupled" or "joined" to the latter with a third component interposed therebetween.

[Constituent of Cleaner]

Figure 2:
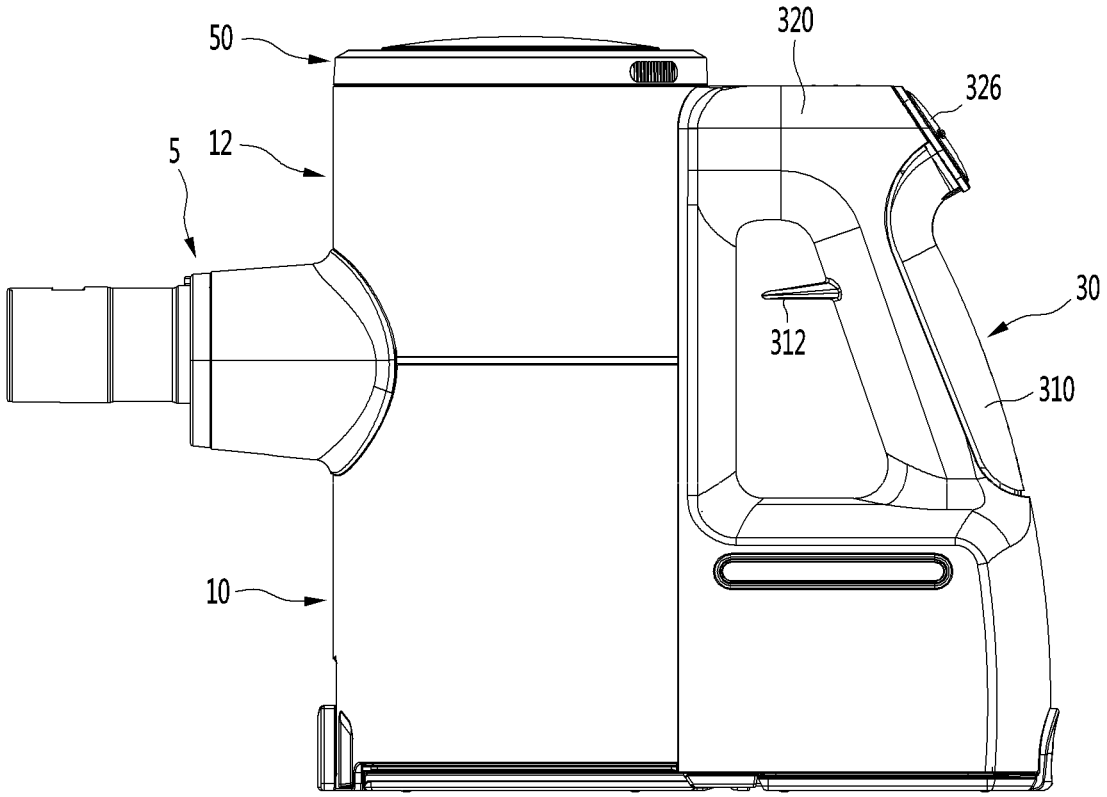
FIG. 2 is a side view of the cleaner according to an embodiment.
Figure 3:
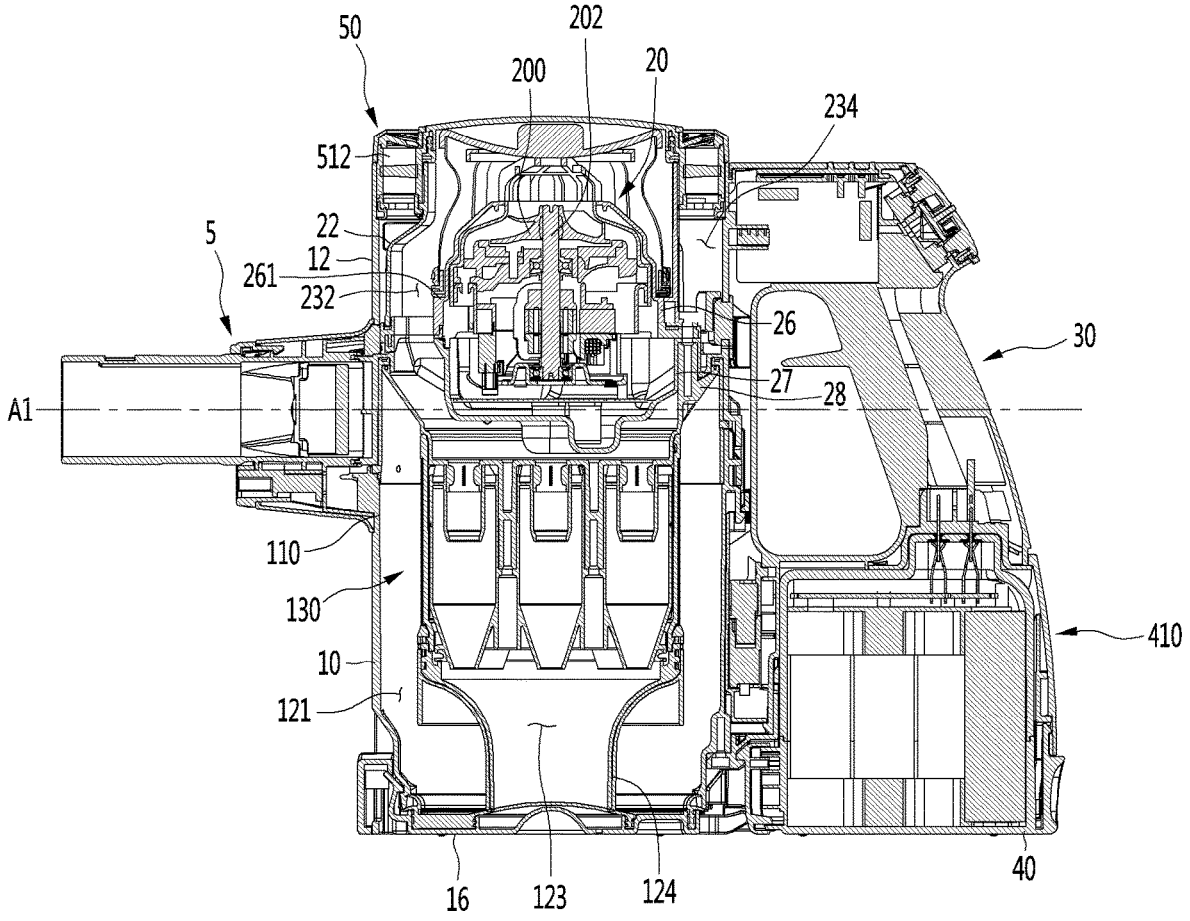
FIG. 3 is a longitudinal cross-sectional view of the cleaner according to an embodiment.

FIG. 1 is a perspective view of a cleaner according to an embodiment, FIG. 2 is a side view of the cleaner according to an embodiment, and FIG. 3 is a longitudinal cross-sectional view of the cleaner according to an embodiment.

Referring to FIGS. 1 to 3, a cleaner 1 according to an embodiment may include a main body 2.

The cleaner 1 may further include a suction inlet 5 coupled to the front of the main body 2. The suction inlet 5 can guide air containing dust into the main body 2.

The cleaner 1 may further include a handle unit 3 coupled to the main body 2. The handle unit 3 may be positioned opposite to the suction inlet 5 on the main body 2. That is, the main body 2 may be disposed between the suction inlet 5 and the handle unit 3.

The main body 2 may include a first body 10 and a second body 12 on the first body 10. The first body 10 and the second body 12 may be directly combined or may be indirectly combined through an intermediate member.

The first body 10 and the second body 12 may be, though not limited thereto, formed in a cylindrical shape.

The first body 10 and the second body 12 are open at the top and the bottom, respectively. That is, the bodies 10 and 12 may have a top opening and a bottom opening, respectively.

The suction inlet 5 may be coupled to the main body 2 such that the center of the suction inlet 5 is positioned approximately at the boundary between the first body 10 and the second body 12.

The main body 2 may further include a dust separation unit that separates dust from air suctioned through the suction inlet 5.

The dust separation unit may include a first cyclone unit 110 that can separate dust, for example, using cyclonic flow. The first body 10 includes the first cyclone unit 110 in this configuration. The air and dust suctioned through the suction inlet 5 helically flow along the inner side of the first cyclone unit 110. The axis of the cyclonic flow in the first cyclone unit 110 may vertically extend.

The dust separation unit may further include a second cyclone unit 130 that separates foreign substances again from the air discharged in the first cyclone unit 110. The second cyclone unit 130 may be disposed in the first cyclone unit 110.

Thus, the dust separation unit may be reduced in size to realize a more compact outer appearance of the cleaner. The second cyclone unit 130 may include a plurality of cyclone bodies that are disposed in parallel to each other.

For another example, the dust separation unit may include a single cyclone unit. In this case, an axis of the cyclone flow may vertically extend.

The first body 10 perform a storage function (or a dust container function) of storing the foreign substances separated in each of the cyclone units 110 and 130.

The main body 2 may further a body cover 16 opening and closing a lower side of the first body 10. The body cover 16 may open and close the first body 10 through a rotation operation thereof.

At least a portion of the second cyclone unit 130 may be disposed in the first body 10.

A dust storage guide 124 guiding the storage of the foreign substances separated in the second cyclone unit 130 may be disposed in the first body 10. The dust storage guide 124 may be coupled to a lower portion of the second cyclone unit 130 to contact a top surface of the body cover 16.

The dust storage guide 124 may partition an inner space of the first body 10 into a first dust storage part 121 storing the dusts separated in the first cyclone unit 110 and a second storage part 123 storing the dusts separated in the second cyclone unit 130.

An inner space of the dust storage guide 124 may be the second dust storage part 123, and a space between the dust storage guide 124 and the first body 10 may be the first dust storage part 121. The body cover 16 may open and close the first dust storage part 121 and the second dust storage part 123 together with each other.

The cleaner 1 may further include a suction motor 20 for generating suction force and a battery 40 for supplying power to the suction motor 20. The suction motor 20 may be disposed in the second body 12. At least a portion of the suction motor 20 may be disposed over the dust separation unit. The suction motor 20 is disposed over the first body 10.

The cleaner 1 may further include a discharge guide 28 communicated with the second cyclone unit 130 and a flow guide 22 that communicates with the discharge guide 28.

For example, the discharge guide 28 is disposed on the second cyclone unit 130 and the flow guide 22 is disposed over the discharge guide 28. Also, the suction motor 20 may be disposed in the flow guide 22. Thus, the axis of the cyclone flow of the dust separation unit may pass through the suction motor 20.

Since the suction motor 20 is disposed above the second cyclone unit 130, the air discharged in the second cyclone unit 130 may directly flow to the suction motor 20. Thus, a passage between the dust separation unit 130 and the suction motor 20 may be minimized.

The suction motor 20 may include a rotating impeller 200. The impeller 200 may be connected to a shaft 202. The shaft 202 may be disposed to extend in a vertical direction (a vertical direction of FIG. 3).

An extension line (that is called a rotation axis of the impeller 200) of the shaft 232 may pass through the first body 10. Here, the rotation axis of the impeller 200 and the axis of the cyclone flow generated in the first cyclone unit 110 of the dust separation unit may be disposed in the same line. According to an embodiment, a flow path of air discharged from the dust separation unit, i.e., air discharged upward from the second cyclone unit 130 toward the suction motor 20 may be reduced to reduce a change in flow direction of the air. Thus, a flow loss of the air may be reduced. When the flow loss of the air is reduced, suction force may increase. Also, a use time of a battery 40 supplying power to the suction motor 20 may increase.

The cleaner 1 may further include a motor housing accommodating the suction motor 20. The motor housing may include an upper motor housing 26 covering a portion of an upper side of the suction motor 20 and a lower motor housing 27 covering a portion of a lower side of the suction motor 20. The suction motor 20 may be accommodated in each of the motor housings 26 and 27, and the flow guide 22 may be disposed to surround the upper motor housing 26.

At least a portion of the flow guide 22 may be spaced apart from the upper motor housing 26. Also, at least a portion of the flow guide 22 may be spaced apart from the second body 12. Thus, an inner circumferential surface of the flow guide 22 and an outer circumferential surface of the upper motor housing 26 may provide a first air passage 232, and an outer circumferential surface of the flow guide 22 and an inner circumferential surface of the second body 12 may provide a second air passage 234.

The air discharged from the second cyclone unit 130 flows to the suction motor 20 through the first air passage 232 and the air discharged from the suction motor 20 flows through the second air passage 234 and is then discharged outside. Accordingly, the second air passage 234 functions as an exhaust channel.

The handle unit 3 may include a handle 30 for a user to hold and a battery housing 410 under the handle 30. The handle 30 may be disposed behind the suction motor 20.

As for directions, with respect to the suction motor 20 in the cleaner 1, the direction in which the suction inlet 5 is positioned is the front direction and the direction in which the handle 30 is positioned is the rear direction.

The battery 40 may be disposed behind the first body 10. Accordingly, the suction motor 20 and the battery 40 may be arranged not to vertically overlap each other and may be disposed at different heights.

According to this embodiment, since the suction motor that is heavy is disposed ahead of the handle 30 and the battery 40 that is heavy is disposed behind the handle 30, so weight can be uniformly distributed throughout the cleaner 1. It is possible to prevent injuries to the user's wrist when a user cleans with the handle 30 in his/her hand. That is, since the heavy components are distributed at the front and rear portions and at different heights in the cleaner 1, it is possible to prevent the center of gravity of the cleaner 1 from concentrating on any one side.

Since the battery 40 is disposed under the handle 30 and the suction motor 20 is disposed in front of the handle 30, there is no component over the handle 30. That is, the top of the handle 30 forms a portion of the external appearance of the top of the cleaner 1.

Accordingly, it is possible to prevent any component of the cleaner 1 from coming in contact with the user's arm while the user cleans with the handle 30 in his/her hand.

The handle 30 may include a first extension 310 extending vertically to be held by a user and a second extension 320 extending toward the suction motor 20 over the first extension 310. The second extension 320 may at least partially horizontally extend.

A stopper 312 for preventing a user's hand holding the first extension 310 from moving in the longitudinal direction of the first extension 310 (vertically in FIG. 2) may be formed on the first extension 310. The stopper 312 may extend toward the suction inlet 5 from the first extension 310.

The stopper 312 is spaced apart from the second extension 320. Accordingly, a user is supposed to hold the first extension 310, with some of the fingers over the stopper 312 and the other fingers under the stopper 312. For example, the stopper 312 may be positioned between the index finger and the middle finger.

According to this arrangement, when a user holds the first extension 310, the longitudinal axis A1 of the suction inlet 5 may pass through the user's wrist.

When the longitudinal axis A1 of the suction inlet 5 passes through the user's wrist and the user's arm is stretched, the longitudinal axis A1 of the suction inlet 5 may be substantially aligned with the user's stretched arm. Accordingly, there is the advantage in this state that the user uses minimum force when pushing or pulling the cleaner 1 with the handle 30 in his/her hand.

The handle 30 may include an operation unit 326. For example, the operation unit 326 may be disposed on an inclined surface of the second extension 320. It is possible to input instructions to turn on/off the suction motor through the operation unit 326. The operation unit 326 may be disposed to face a user. The operation unit 326 may be disposed opposite to the stopper 312 with the handle 30 therebetween. The operation unit 326 may be positioned higher than the stopper 312. Accordingly, a user can easily operate the operation unit 326 with his/her thumb with the first extension 310 in his/her hand.

Further, since the operation unit 390 is positioned outside the first extension 310, it is possible to prevent the operation unit 390 from being unexpectedly operated when a user cleans with the first extension 310 in his/her hand.

A display unit 322 for showing operational states may be disposed on the second extension 320. The display unit 320 may be, for example, disposed on the top of the second extension 320.

The display unit 322, though not limited, may include a plurality of light emitting devices. The light emitting devices may be spaced apart from each other in the longitudinal direction of the second extension 320. The display 322, for example, can show the remaining capacity of the battery 40 and the intensity of the suction motor.

The battery housing 410 may be disposed under the first extension 310. The battery 40 may be detachably received in the battery housing 410. For example, the battery 40 may be inserted into the battery housing 60 from under the battery housing 410.

The rear side of the battery housing 60 and the rear side of the first extension 310 may form a continuous surface.

Accordingly, the battery housing 60 and the first extension 310 can be shown like a single unit.

[Filter Cap and Filter Mechanism of Cleaner]

Figure 4:
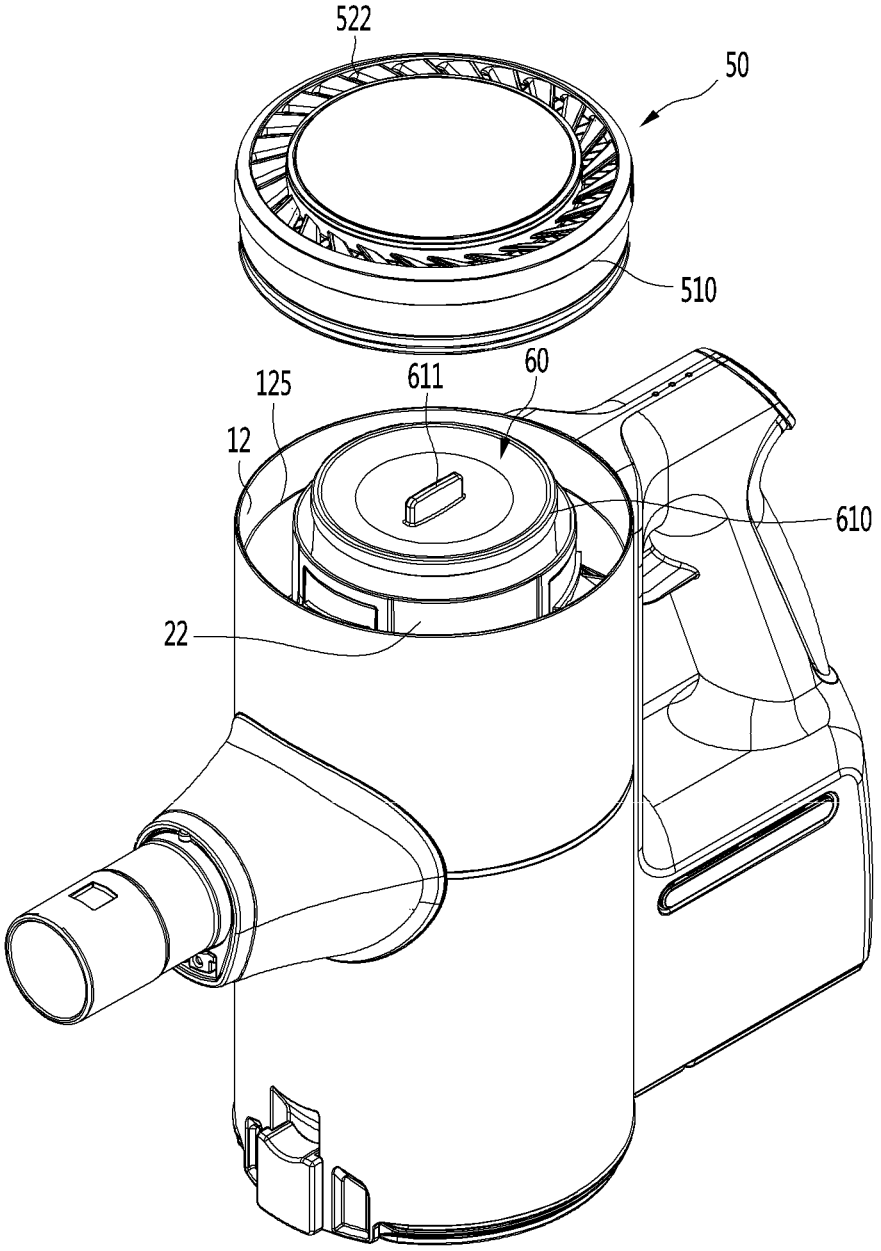
FIG. 4 is a view illustrating a state in which an opening cover is separated from a main body according to an embodiment.
Figure 5:
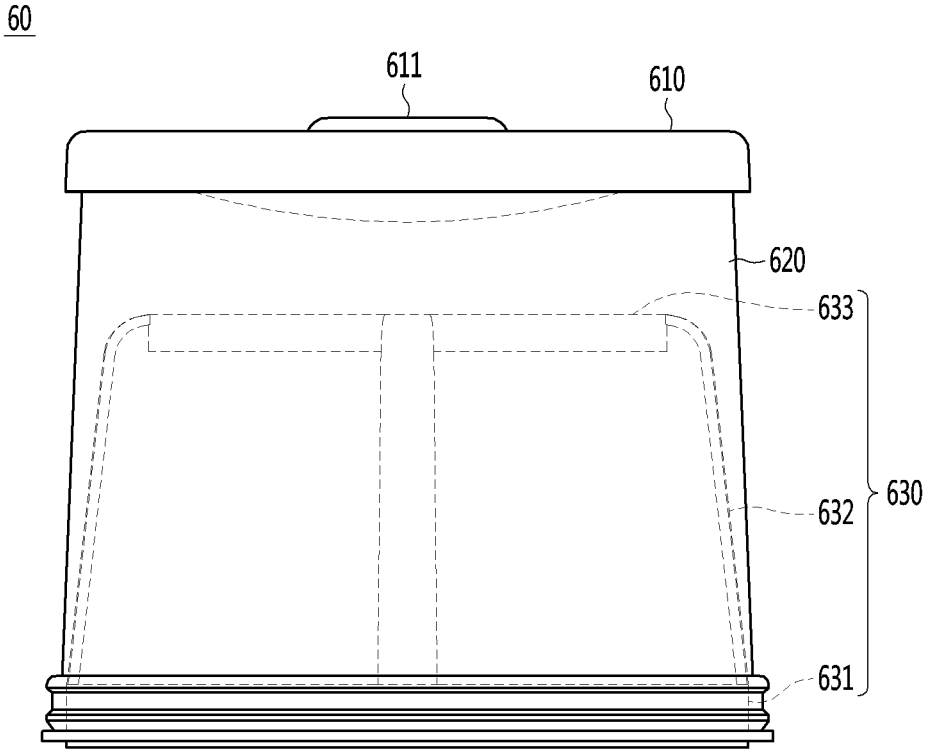
FIG. 5 is a front view of a filter mechanism according to an embodiment.

FIG. 4 is a view illustrating a state in which the opening cover is separated from the main body according to an embodiment, and FIG. 5 is a front view of the filter mechanism according to an embodiment.

Referring to FIGS. 3 and 4, the cleaner 1 may further include a filter cap 50 detachably coupled to the main body 2. The filter cap 50 may cover the upper opening of the main body 2.

Thus, the filter cap 50 may be called an opening cover.

The filter cap 50 may include air exits 522 for discharging the air that has passed through the suction motor 20.

The filter cap 50 may be detachably coupled to the second body 12. When the filter cap 50 is combined with the main body 2, a portion of the filter cap 50 is positioned outside the second body 12. Accordingly, a portion of the filter cap 50 is inserted in the main body 2 through the open top of the main body 2 and the other portion protrudes outside from the main body 2.

The height of the main body 2 may be substantially the same as the height of the handle 30. Accordingly, the filter cap 50 protrudes upward from the main body 2, so a user can easily hold and separate the filter cap 50.

The air exits 522 are positioned at the upper portion of the filter cap 50. Accordingly, the air discharged from the suction motor 20 is discharged upward from the main body 2.

According to this embodiment, it is possible to prevent the air discharged from the air exits 522 from flowing to a user while the user cleans using the cleaner 1.

The main body 2 may further include a filter mechanism 60 filtering the air discharged from the suction motor 20. The filter mechanism 60 may include a filter unit 620.

In the state in which the filter cap 50 is separated from the main body 2, the filter mechanism 60 may be exposed to the outside.

At least a portion of the filter mechanism may be disposed in the flow guide 22. That is, the flow guide 22 may have a filter accommodation function of accommodating the filter mechanism 60. The filter mechanism 60 may be seated on the upper motor housing 26 and surround a portion of the upper motor housing 26. That is, the upper motor housing 26 may include a filter support 261 supporting the filter mechanism 60.

When the filter mechanism 60 is supported by the filter support 261, an upper end of the filter mechanism 60 may have a height higher than that of an upper end of the main body 2. In other words, to secure a wider filter area, when the filter mechanism 60 is mounted on the main body 2 in the state in which the filter cap 50 is separated, the cleaner 1 may protrude upward from the main body 60 in the cleaner 1.

When the motor 20 is driven, the air discharged from the first and second cyclone units 110 and 130 be discharged to the outside via the first air passage 232 provided in the inner circumferential surface of the flow guide 22 and the outer circumferential surface of the upper motor housing 26 and the second air passage 234 provided in the outer circumferential surface of the flow guide 22 and the inner circumferential surface of the second body 12.

Here, the air flowing through the first air passage 232 may be primarily filtered by the filter mechanism 60. Also, the air passing through the filter mechanism 60 may be secondarily filtered by a filter 510 provided in the filter cap 50 while flowing through the second air passage 234.

<Detailed Constituent of Filter Cap>

Referring to FIG. 4, the filter cap 50 may include a first filter cap body 510 defining an outer appearance thereof. The first filter cap body 510 may having an approximately cylindrical shape. The air discharge hole 522 including a plurality of openings may be defined in an upper portion of the first filter cap body 510. The plurality of openings of the air discharge hole 522 may be arranged in a circumferential direction of the first filter cap body 510.

The filter cap 50 may further include a filter 512 for filtering foreign substances contained in the air to be exhausted. For example, the filter 512 may include a high efficiency particulate air (HEPA) filter. In the state in which the filter cap 50 is coupled to the main body 2, the filter 512 may be disposed to surround the flow guide 22 so as to prevent the cleaner 1 from increasing in height.

In other words, for example, the filter 512 may have a ring shape. At least a portion of the flow guide may be disposed in a region defined by the filter 512.

In this specification, since the filter 512 filters the foreign substances contained in the air to be exhausted, the filter 512 may be called an exhaust filter.

When the exhaust filter 512 and the filter unit 620 are disposed in the second body 12, at least a portion of the filter unit 620 may be accommodated in a region defined by the exhaust filter 512 to prevent an increases in height. That is, the exhaust filter 512 may surround the filter unit 620.

An axis of the cyclone flow of the first cyclone unit 110 may pass through the filter 512 and the filter mechanism 60. For example, the axis of the cyclone flow may pass through a region defined by the filter 512. That is, the axis of the cyclone flow of the first cyclone unit 110 may pass through an opening of a center of the filter 512.

<Detailed Constituent of Filter Mechanism>

Figure 6:
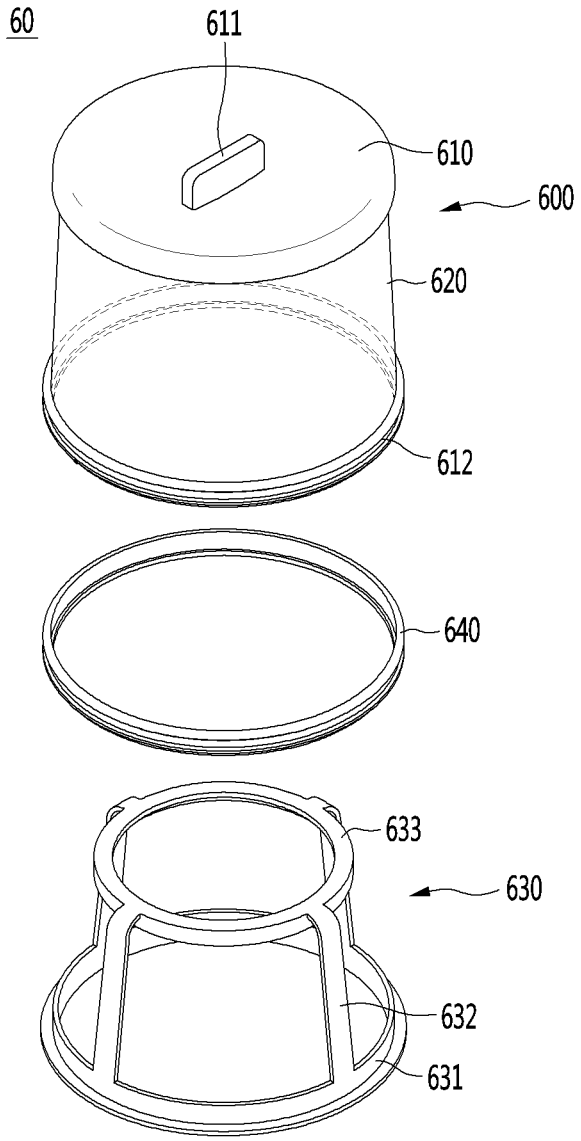
FIG. 6 is an exploded perspective view of the filter mechanism according to an embodiment.

Referring to FIGS. 4 to 6, the filter mechanism 60 may include a filter member 600 including the filter unit 620 for purifying air.

The filter member 600 may further include an upper body 610 coupled to an upper portion of the filter unit 620. The upper body 610 may have, for example, a cylindrical shape.

A protrusion 611 protruding upward may be disposed on the upper body 610. The user may grasp the protrusion 611 protruding to the outside to lift the filter mechanism 60 upward, thereby separating the filter mechanism 60 from the main body 2. Since the filter mechanism 60 is separated from the main body 2, the user may easily clean the filter mechanism 60.

The filter unit 620 may have an approximately cylindrical shape. For example, the filter unit 620 may be coupled to a circumferential portion of a lower end of the upper body 610. Air in the first air passage 232 may pass through the filter unit 620. Also, foreign substances contained in the air may be filtered by the filter unit 620.

The filter unit 620 may be a mash filter having a cylindrical shape. For example, the filter unit 620 may include materials of nylon and spun-bonded fabric.

The spun-bonded fabric may be a kind of nonwoven fabric produced by spinning a synthetic fiber such as polypropylene (PP) and then applying heat thereto. The polypropylene has a low fatigue property against bending. Also, the nylon has elasticity.

Thus, when the filter unit 620 is made of the nylon and the polypropylene, a loss in durability of the filter unit 620 due to the bending (or wrinkling) may be reduced. Also, the filter unit 620 may be easily restored to its original shape even if the bending (or the wrinkling) occurs in at least a portion of the outer surface due to external force. In other words, the filter unit 620 may be easily bent by the external force. Also, when the external force is not applied to the filter unit 620, the filter unit 620 may be easily restored in its original shape.

The filter unit 600 may further include a filter fixing part 612 coupled to a lower portion of the filter unit 620. When the external force is applied to the filter mechanism 60, at least a portion of the filter unit 620 between the upper body 610 and the filter fixing part 612 may be bent.

The filter mechanism 60 may further include a filter frame 630 supporting the filter member 600. For example, the lower portion of the filter unit 620 and/or the filter fixing part 612 may be supported by the filter frame 630.

At least a portion of the filter frame 630 may be accommodated in the filter unit 620. Also, a remaining portion of the filter frame 630 may support the filter unit 620 or a lower end and side surface of the filter fixing part 612.

The filter frame 630 may include an upper frame disposed directly below the upper body 610.

Also, the filter frame 630 may further include a lower frame 631 supported by the filter support 261 of the upper motor housing 26.

The lower frame 631 may have a shape corresponding to that of the filter support 261. The lower frame 631 may have, for example, a ring shape having an opening. Thus, the motor housing of the suction motor 20 may pass through the lower frame 631.

The lower frame 631 may have a diameter greater than that of the upper frame 633.

The upper frame 633 may be spaced upward from the lower frame 631.

In the state in which the filter cap 50 is separated from the main body 2, the upper frame 633 may be spaced a second set height (H2 of FIG. 7) from the upper body 610. In summary, the upper frame 633 may be disposed between the upper body 610 and the lower frame 631. The upper frame 633 may have a ring shape having an opening. A portion of the upper body 610 may pass through the opening.

The filter frame 630 may further include a connection frame 632 connecting the lower frame 631 to the upper frame 633.

The connection frame 632 may be made of a polypropylene (PP) material. The connection frame 632 may be provided in plurality. The plurality of connection frames 632 may be disposed to be horizontally spaced apart from each other. A passage through which air flows may be provided between the plurality of side frames 632.

The upper frame 633 of the filter frame 630 may be spaced the second set height (H2 of FIG. 7) from the upper body 610. The filter unit 620 may have a shape extending from a lower portion of the upper body 610 up to the filter fixing part 612. Also, an inner surface of the filter unit 620 may contact or be spaced apart from at least a portion of the plurality of side frames 632.

When the external force is not applied to the upper body 610, one point of the filter unit 620, which contacts a lower end of the upper body 610, may be maintained at the second set height (H2 of FIG. 7) from the upper frame 633.

Also, while the filter cap 50 is coupled to the main body 20, the filter cap 50 may press the upper body 610 in a direction of the gravity.

When external force is applied to the upper body 610 in the direction of the gravity (downward in FIG. 5), the upper body 610 may move in a direction (downward) that is close to the upper frame 633 to allow the upper body 610 to contact the upper frame 633 and to be supported by the upper frame 633. Also, while the upper body 610 moves downward, the filter unit 620 may be bent.

According to the above-described constitutes, while the filter area of the filter unit 620 is maintained, the filter mechanism 60 may be reduced. Thus, the filter area of the filter mechanism 60 may increase without changing the structure of the cleaner 1. That is, the filter area of the filter mechanism 60 may increase without changing a design of the main body 10 so that the main body 10 has a larger size. When the filter area increases, the foreign filtering performance of the cleaner 1 may be improved. Furthermore, since the dust accommodation capacity of the filter unit 620 increases, the deterioration of the suction performance may be reduced even though the use time of the cleaner 1 increases.

The filter mechanism 60 may further include a sealing member 640 disposed between the filter fixing part 612 and the lower frame 631. The air may not pass through the filter unit 620 by the sealing member 640, and also, the lower frame 631 and the filter fixing part 612 may be prevented from moving with respect to each other.

Figure 7:
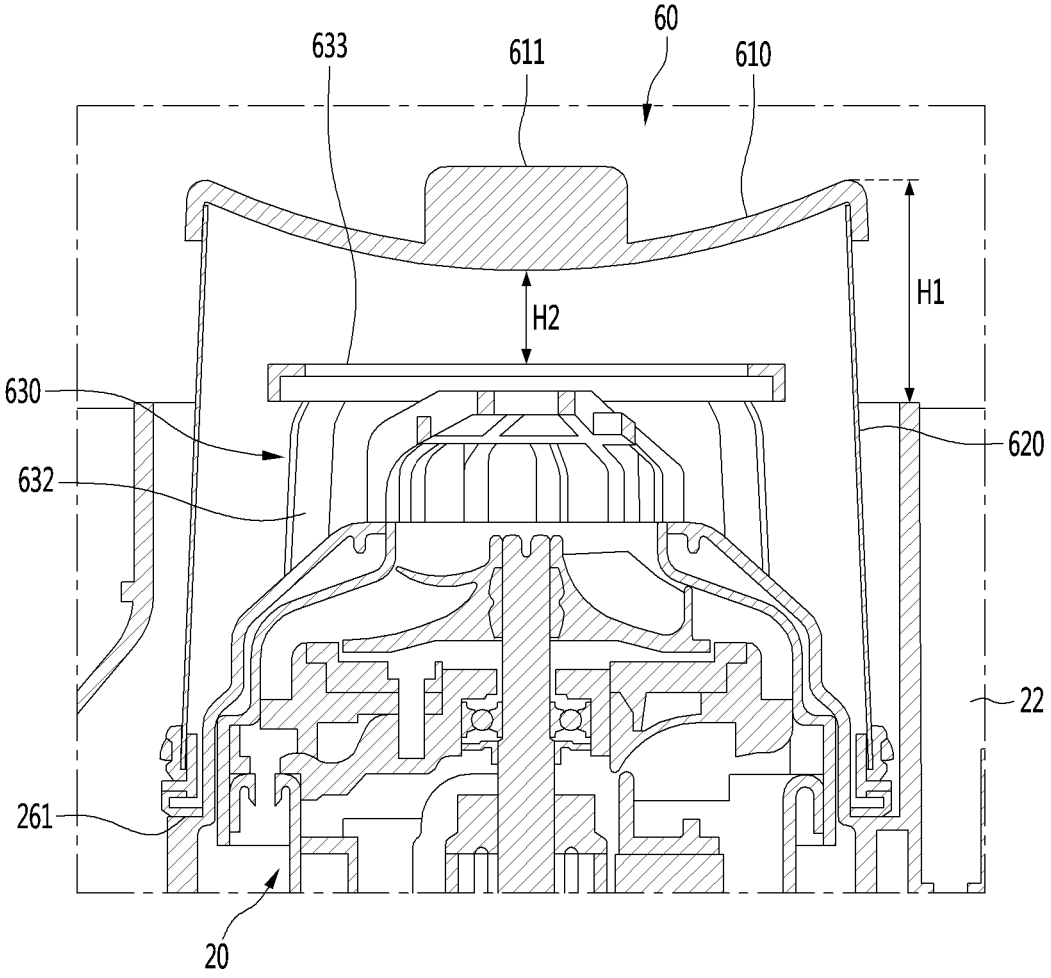
FIG. 7 is a partially enlarged view of the filter mechanism mounted in a filter accommodation part when the opening cover is separated from the main body in FIG. 3.
Figure 8:
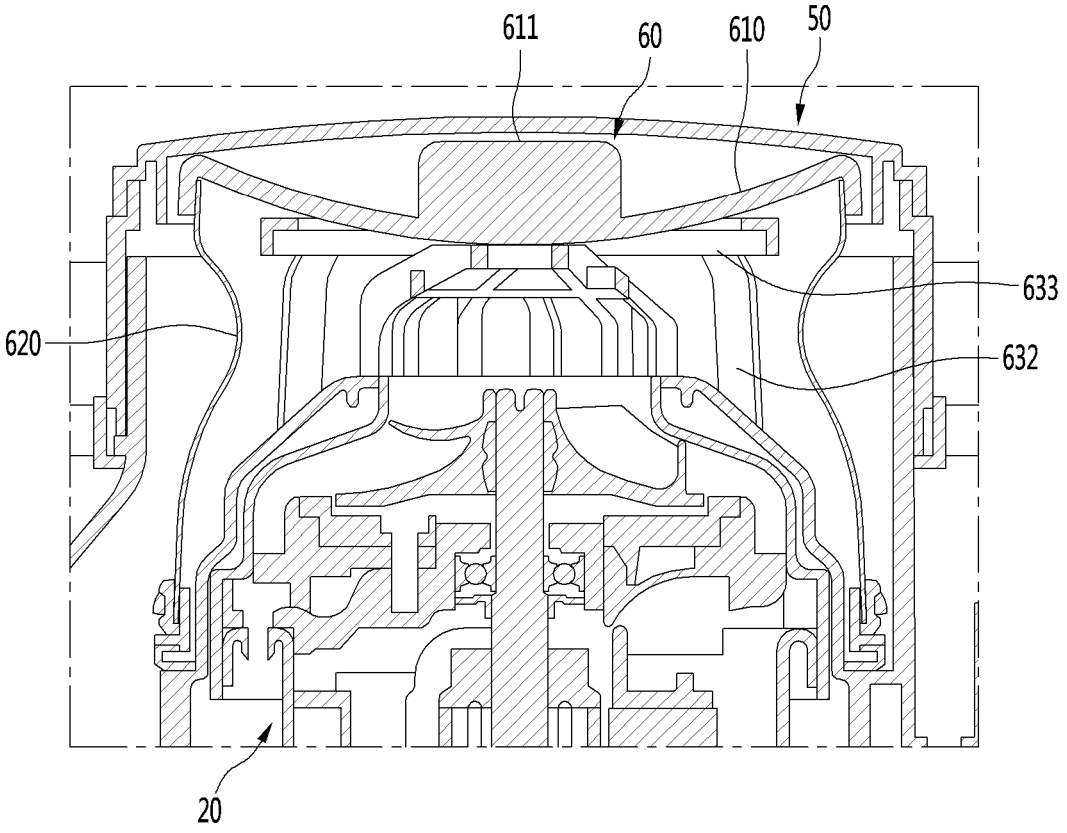
FIG. 8 is a partially enlarged view of the filter mechanism mounted in a filter accommodation part when the opening cover is mounted on the main body in FIG. 3.

FIG. 7 is a partially enlarged view of the filter mechanism mounted in a filter accommodation part when the opening cover is separated from the main body in FIG. 3, and FIG. 8 is a partially enlarged view of the filter mechanism mounted in a filter accommodation part when the opening cover is mounted on the main body in FIG. 3.

First, referring to FIG. 7, in the state in which the filter cap 50 is separated from the main body 2, the filter mechanism 60 may be exposed to the outside.

In the state in which the filter mechanism 60 is supported by the filter support of the main body 2, an upper portion of the filter mechanism 60 may protrude by a first set height H1 from an upper portion of the main body 2.

Also, one point of the filter unit 620, which contacts the lower end of the upper body 610, may be maintained at the second set height H2 from the upper frame 633.

Referring to FIG. 8, when the filter cap 50 is mounted on the main body 2, the filter mechanism 60 may be pressed downward by the filter cap 50.

That is, while the filter cap 50 is coupled to the main body 2, the filter cap 50 may press the upper body 610 downward.

In this process, the upper body 610 may move downward and be supported by the upper frame 633. That is, the upper body 610 may be pushed by the second set height H2 downward.

Also, the height of the filter unit 620 may be lowered by the second set height H2. In this process, a portion of the filter unit 620 may be bent toward the connection frame 632 of the filter frame 830.

Thus, the filter area of the filter unit 620 may increase without changing the outer appearance of the main body 2 of the cleaner 1.

According to the proposed embodiment, the filter area may increase without changing the structure of the cleaner body.

Particularly, the filter may have a volume greater than that of the accommodation space of the filter provided in the main body. Also, when accommodated in the main body, the filter may be bent to be accommodated in the accommodation space of the filter. Thus, the filter may increase in area without changing the structure of the filter accommodation part. Therefore, the cleaner having the efficiently improved foreign substance filtering performance may be provided.

The total amount of foreign substances that are capable of being accommodated in the filter may increase due to the increase in area of the filter. Therefore, the loss in suction performance of the cleaner due to the accumulation of the cleaning time may be reduced.

What is claimed is:

1. A cleaner comprising:

a main body having an opening;

a suction motor accommodated in the main body and configured to generate suction force;

an opening cover separably coupled to the main body and configured to cover the opening; and a filter mechanism accommodated in the main body through the opening and configured to filter foreign substances of air discharged by the suction motor, the filter mechanism comprising a filter unit configured to filter the foreign substances, an upper body coupled to an upper portion of the filter unit, and a filter frame disposed inside of the filter unit, wherein the upper body and at least a portion of a lateral side of the filter unit are configured to:

based on the opening cover being separated from the main body, protrude to an outside of the main body through the opening, and based on the opening cover coupling to the main body and applying pressure to the upper body, be accommodated in the main body, and wherein a height of the filter frame in the main body is configured to be maintained while the opening cover is separated from the main body.

2. The cleaner of claim 1, wherein at least the portion of the lateral side of the filter unit is configured to bend based on the opening cover coupling to the main body.

3. The cleaner of claim 1, wherein the filter frame comprises an upper frame disposed vertically below the upper body.

4. The cleaner of claim 3, wherein, in a state in which the opening cover is separated from the main body, the upper body is spaced apart from the upper frame, and while the opening cover is coupled to the main body, a spaced distance between the upper body and the upper frame is reduced.

5. The cleaner of claim 4, wherein the upper frame has a ring shape comprising an opening.

6. The cleaner of claim 5, wherein, when the opening cover is coupled to the main body, a portion of the upper body passes through the opening of the upper frame.

7. The cleaner of claim 3, wherein the filter frame further comprises:

a lower frame spaced apart from the upper frame; and a connection frame configured to connect the upper frame to the lower frame.

8. The cleaner of claim 7, wherein each of the upper frame and the lower frame has a ring shape, and wherein a diameter of the lower frame is greater than a diameter of the upper frame.

9. The cleaner of claim 7, further comprising a motor housing configured to accommodate the suction motor, wherein the motor housing comprises a support part configured to support the lower frame.

10. The cleaner of claim 7, wherein the lower frame is spaced apart from the upper frame in a first direction, and wherein the connection frame comprises a plurality of connection frames that are spaced apart from each other in a second direction and that connect the upper frame to the lower frame, the second direction crossing the first direction.

11. The cleaner of claim 7, wherein the filter mechanism further comprises:

a filter fixing unit fixed to a lower portion of the filter unit; and a sealing member configured to prevent the air from leaking between the filter fixing unit and the lower frame.

12. The cleaner of claim 3, further comprising a motor housing configured to accommodate the suction motor, wherein at least a portion of the filter frame surrounds the motor housing.

13. The cleaner of claim 1, wherein the upper body comprises a protrusion that protrudes upward from the upper body and that is configured to, based on the opening cover coupling to the main body, be pressed by the opening cover.

14. The cleaner of claim 1, wherein the opening cover comprises an air discharge hole through which the air is discharged.

15. A cleaner comprising:

a main body having an opening;

a suction motor accommodated in the main body and configured to generate suction force;

an opening cover separably coupled to the main body and configured to cover the opening;

a filter member accommodated in the main body through the opening, the filter member comprising a filter unit configured to filter air, and an upper body coupled to an upper portion of the filter unit; and a filter frame configured to support the filter member, the filter frame comprising an upper frame disposed below the upper body, a lower frame spaced apart from the upper frame, and a connection frame that connects the upper frame to the lower frame, wherein the upper frame and the connection frame are disposed inside of the filter unit, wherein the upper body and at least a portion of a lateral side of the filter unit are configured to, based on the opening cover being separated from the main body, protrude to an outside of the main body through the opening such that the upper body is spaced apart from the upper frame, and wherein the opening cover is configured to, based on coupling to the main body, move the upper body toward the upper frame and bend at least the portion of the lateral side of the filter unit such that the at least the portion of the lateral side of the filter unit is accommodated in the main body.

16. The cleaner of claim 15, further comprising a motor housing configured to accommodate the suction motor, wherein the filter frame is seated on the motor housing.

17. The cleaner of claim 16, wherein at least a portion of the filter frame surrounds the motor housing.

18. The cleaner of claim 15, further comprising a motor housing configured to accommodate the suction motor, wherein at least a portion of the filter unit surrounds the motor housing.

19. The cleaner of claim 1, wherein the lateral side of the filter unit is configured to:

based on the opening cover being separated from the main body, extend from a first position inside of the main body to a second position at the outside of the main body, and based on the opening cover coupling to the main body, retract from the second position at the outside of the main body to the first position inside of the main body.

20. A cleaner comprising:

a main body having an opening;

a suction motor accommodated in the main body and configured to generate suction force;

an opening cover separably coupled to the main body and configured to cover the opening; and a filter mechanism accommodated in the main body through the opening and configured to filter foreign substances of air discharged by the suction motor, the filter mechanism comprising a filter unit configured to filter the foreign substances, an upper body coupled to an upper portion of the filter unit, and a filter frame disposed inside of the filter unit, wherein the filter frame comprises an upper frame disposed vertically below the upper body, wherein the upper body and at least a portion of a lateral side of the filter unit are configured to:

based on the opening cover being separated from the main body, protrude to an outside of the main body through the opening, and based on the opening cover coupling to the main body and applying pressure to the upper body, be accommodated in the main body, wherein the upper body is configured to be separated from the upper frame in a state in which the opening cover is separated from the main body, and wherein a spaced distance between the upper body and the upper frame is configured to decrease while the opening cover is coupled to the main body.

* * * * *